US008337211B1

(12) United States Patent
Hughes

(10) Patent No.: US 8,337,211 B1
(45) Date of Patent: Dec. 25, 2012

(54) PRAYER BEAD LARIAT

(76) Inventor: Gary M. Hughes, Old Mill Creek, IL (US)

( * ) Notice: Subject to any disclaimer, the term of this patent is extended or adjusted under 35 U.S.C. 154(b) by 410 days.

(21) Appl. No.: 12/554,049

(22) Filed: Sep. 4, 2009

Related U.S. Application Data

(60) Provisional application No. 61/190,891, filed on Sep. 4, 2008.

(51) Int. Cl.
*A44C 23/00* (2006.01)

(52) U.S. Cl. ..... 434/246

(58) Field of Classification Search ..... 434/188, 434/203, 204, 246; 63/1.11, 3, 4, 10, 21, 63/23; 368/224, 225
See application file for complete search history.

(56) References Cited

U.S. PATENT DOCUMENTS

| | | | | |
|---|---|---|---|---|
| 1,579,820 | A * | 4/1926 | Kislinger | 63/3 |
| 2,937,459 | A * | 5/1960 | Belfield | 434/246 |
| 2,990,625 | A * | 7/1961 | Mues | 434/246 |
| 2,992,495 | A * | 7/1961 | Perreira | 434/246 |
| 4,573,243 | A | 3/1986 | Plaza | |
| 5,050,276 | A | 9/1991 | Pemberton | |
| 5,694,791 | A | 12/1997 | Esposito | |
| 6,170,127 | B1 | 1/2001 | Lim | |
| 6,179,621 | B1 | 1/2001 | Vaccari | |
| 6,308,385 | B1 | 10/2001 | Ball | |
| 6,324,868 | B1 | 12/2001 | Chen et al. | |
| 6,422,036 | B1 | 7/2002 | Giannis et al. | |
| D474,872 | S | 5/2003 | Sullivan | |
| 6,612,130 | B2 | 9/2003 | Ito | |
| 7,513,774 | B2 * | 4/2009 | Krilich | 434/246 |
| 2005/0282127 | A1 * | 12/2005 | Adams | 434/246 |

* cited by examiner

*Primary Examiner* — Kurt Fernstrom

(74) *Attorney, Agent, or Firm* — Montgomery Patent & Design LLC; Robert C. Montgomery; Joseph Yaksich

(57) ABSTRACT

A prayer bead lariat comprising a bail fitting allowing a plurality of beads to pass through the bail fitting, thereby assisting a user to recite the corresponding prayers or recitations through the use of the prayer bead, is herein disclosed.

12 Claims, 1 Drawing Sheet

PRAYER BEAD LARIAT

RELATED APPLICATIONS

The present invention was first described in and claims the benefit of U.S. Provisional Patent No. 61/190,891 filed Sep. 4, 2008, the entire disclosures of which are incorporated herein by reference.

FIELD OF THE INVENTION

The present invention relates generally to a new and improved prayer bead, and in particular, to a prayer bead lariat comprising a bail fitting, thereby allowing a plurality of beads to incrementally pass through the bail fitting and enabling a user to more easily recite the corresponding prayers or recitations.

BACKGROUND OF THE INVENTION

Prayer beads have been used in many traditions to keep count of the repetitions of prayers, recitations, chants, and devotions. Such prayer counters have been used broadly by a multitude of historical religions in every age. The religions whose participants are known to utilize prayer beads include Christianity, Buddhism, Hinduism, and Islam, among others. Even non-denominational prayer beads exist to help people with spiritual practices and personalized uses without adhering solely to any one (1) religion or creed. Also, it has become increasingly popular to wear prayer beads around the neck. These prayer beads are a very important part of many people's daily routines. However, it can be extremely difficult to use prayer beads in a manner that is discreet and private and will not offend others in public settings. Furthermore, traditional prayer beads can be difficult to use with one hand while also trying to move the fingers along the beads as the prayers are recited. Accordingly, there is a need for a means by which prayer beads can be used quickly and easily in a discreet and private manner. The development of the present invention fulfills this need.

Various attempts have been made to provide ornamental designs for prayer beads in the manner of a rosary, for example U.S. Pat. No. D 474,872. However, none of these designs are similar to the present invention.

While these devices fulfill their respective, particular objectives, each of these references suffer from one (1) or more of the aforementioned disadvantages. Many such designs are unfit for wear around the neck. Also, many such designs are not designed for discrete use in public. Furthermore, many such designs do not allow beads to be manipulated in a manner which is simple and discrete. Accordingly, there exists a need for prayer beads without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to utilize prayer beads in a manner which is simple and discrete and which allows the user to easily manipulate the beads, even with a single hand. Thus, the object of the present invention is to solve the aforementioned disadvantages and provide for this need.

To achieve the above objectives, it is an object of the present invention to provide a prayer bead lariat, where the prayer bead assembly comprises a plurality of beads and a chain connecting the beads. It is envisioned that the assembly will comprise a variety of different beads.

Another object of the present invention is to provide a pendant assembly comprising of a first and second pendant portion. The first pendant portion is connected to the second portion by means of a pendant chain.

Yet still another object of the present invention is to provide a bail with an aperture with the bail slidingly connected to the prayer bead assembly and connected to the pendant assembly. The purpose of the bail is to allow the prayer bead assembly to pass through the aperture in a sideways sliding motion.

Yet still another object of the present invention is to provide both pendant portions with a variety of components which represent various religious symbols. It is also envisioned that the plurality of beads associated with the prayer bead assembly will comprise a variety of different beads associated with different religions.

Yet still another object of the present invention is to provide a method of utilizing the device that provides a unique means of using prayer beads in a manner which allows them to be worn around the neck or handled manually in a manner which is simple and discrete.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
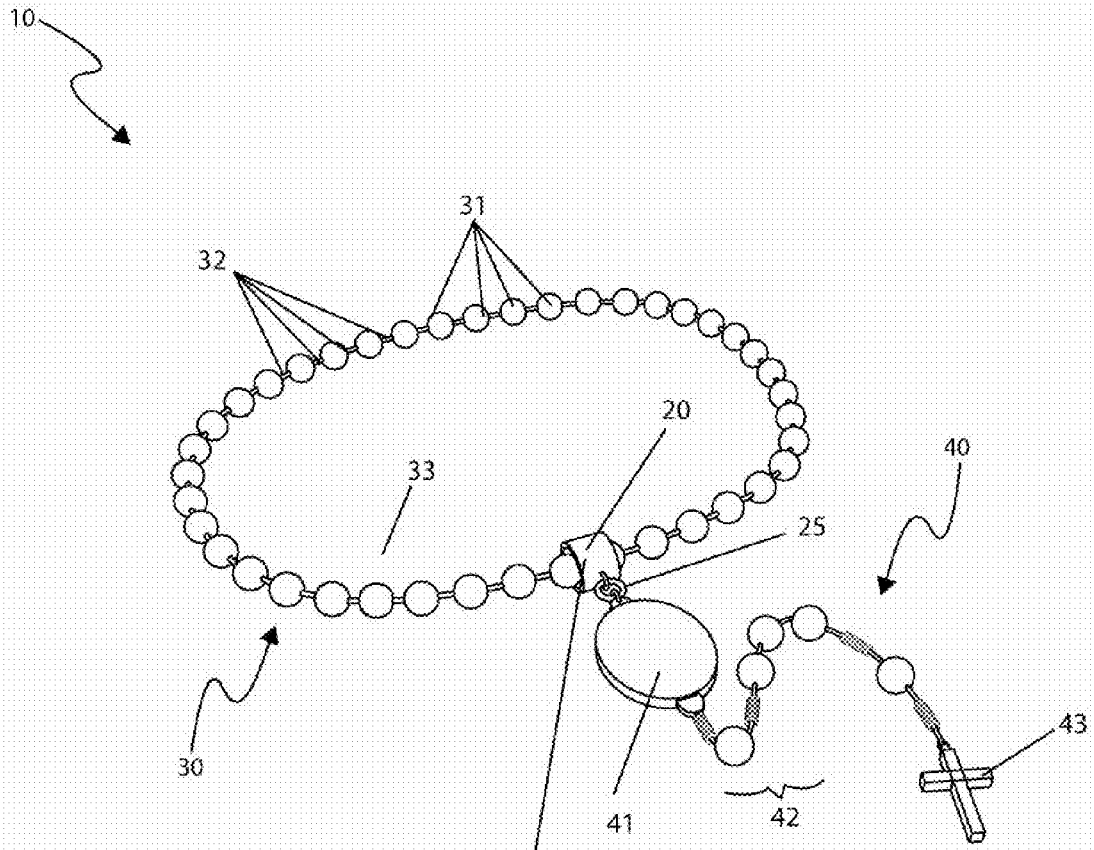
FIG. 1 is a perspective view of a prayer bead lariat 10, according to a preferred embodiment of the present invention; and, FIG. 2 is a close-up of a bail portion 20 of a prayer bead lariat 10, according to a preferred embodiment of the present invention.

10 prayer bead lariat
20 bail fitting
22 orifice
25 pendant connector
30 prayer bead assembly
31 bead
32 chain
33 prayer bead motion
40 pendant
41 first pendant portion
42 pendant chain
43 second pendant portion

DETAILED DESCRIPTION OF THE PREFERRED EMBODIMENT

Figure 2:
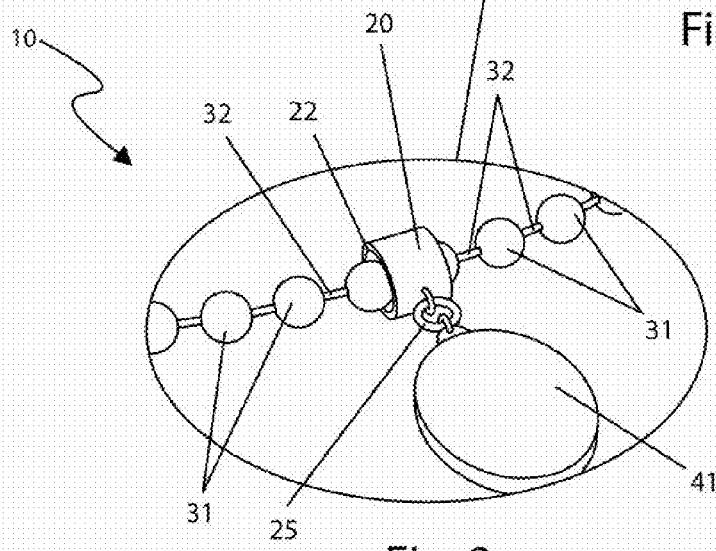

The best mode for carrying out the invention is presented in terms of its preferred embodiment, herein depicted within FIGS. 1 and 2. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and that example configurations shall be shown and described for purposes of clarity and disclosure and not by way of limitation of scope.

The terms "a" and "an" herein do not denote a limitation of quantity, but rather denote the presence of at least one of the referenced items.

The present invention describes a prayer bead lariat (herein described as the "device") 10, which provides a means for a prayer bead assembly 30 which allows beads 31, such as those found on common Rosary beads, to move therethrough a cylindrical bail fitting 20 affixed thereto a pendant 40 such as a crucifix or cross, thereby allowing said pendant 40 to remain at a stationary position during recitation of prayers. The device 10 allows a user to more easily utilize prayer beads. Furthermore, the user can use the device 10 in a more discreet and unobtrusive manner.

Referring now to FIGS. 1 and 2, perspective and close-up views of the device 10, according to the preferred embodiment of the present invention, are disclosed. The device 10 comprises a bail fitting 20, a prayer bead assembly 30, and a pendant 40. The bail 20 comprises a round or elliptical open-ended cylinder providing a central orifice 22 with which the prayer bead assembly 30 is loosely inserted therethrough. The orifice 22 provides an inner diameter of approximately one-half (½) inch such that the prayer bead assembly 30 may freely pass therethrough said bail 20, thereby providing a side-ways sliding motion 33 of said prayer bead assembly 30. The prayer bead assembly 30 is envisioned to further comprise conventional features common to prayer beads such as, but not limited to: a plurality of glass or plastic beads 31 and an interconnecting segmented or continuous chain 32. The bail fitting 20 also provides an attachment thereto a pendant 40 along a lower surface using conventional jewelry attachment techniques such as soldering or the like. The device 10 is illustrated here depicting attachment thereto a traditional cross pendant; however, various styles and types of pendants 40 may be provided as well comprising various components representing various religious symbols. The sliding prayer bead motion 33 allows the prayer bead assembly 30 to rotate therearound while the pendant 40 remains stationary during use, for example, when reciting the Rosary prayer, other prayers, or other recitations.

Also, the device 10 allows a user to more easily utilize prayer beads in a more discreet and unobtrusive manner. The user of said device 10 can now recite prayers at work or in public in a discreet and private manner because the device 10 allows for the side-ways sliding motion 33 of the prayer bead assembly 30 therethrough the bail fitting 20 while keeping the pendent 40 stationary. For example, this allows the user to keep the device 10 in one's pocket and still use the prayer beads to recite prayers or other recitations in a quick and easy manner.

Furthermore, people sometimes wear prayer beads around one's neck. An additional benefit of the device 10, when worn around a neck, is the prayer bead motion 33 allows the prayer bead assembly 30 to rotate therearound the neck of the user while the pendant 40 remains stationary thereupon one's chest area during use, for example, when reciting the Rosary prayer, other prayers, or other recitations. Therefore, the device 10 also allows the user to more easily utilize prayer beads if worn around the neck.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be utilized as indicated in FIG. 1.

The method of utilizing the device 10 may be achieved by performing the following steps: holding the prayer bead assembly portion 30 of the device 10 therein one's hand in a normal manner; grasping an individual bead 31 therewith one's fingers; reciting a corresponding prayer or recitation; sequentially reciting additional prayers, chants, or recitations while grasping subsequent beads 31, thereby resulting in a sideways prayer bead motion 33; allowing the prayer bead assembly 30 to incrementally pass therethrough the bail 20 as the pendant 40 remains stationary; continuing to recite said prayers or recitations as desired; and, benefiting from a more stable and easy to use prayer bead assembly 30 and pendant 40 position while reciting one's prayers or recitations using the present invention 10.

An alternate method of utilizing the device 10, if the device 10 is worn around the neck of the user, may be achieved by performing the following steps: placing the prayer bead assembly portion 30 of the device 10 therearound one's neck in a normal manner; positioning the pendant portion 40 thereupon one's chest area; grasping an individual bead 31 therewith one's fingers; reciting a corresponding prayer or recitation; sequentially reciting additional prayers, chants, or recitations while grasping subsequent beads 31, thereby resulting in a sideways prayer bead motion 33; allowing the prayer bead assembly 30 to incrementally pass therethrough the bail 20 as the pendant 40 remains stationary; continuing to recite said prayers or recitations as desired; and, benefiting from a more stable and easy to use prayer bead assembly 30 and pendant 40 position while reciting one's prayers or recitations using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A prayer bead lariat, comprising:

a prayer bead assembly;

a pendant assembly; and, a bail having an aperture, wherein said bail is slidingly connected therearound said prayer bead assembly and said bail is directly connected to said pendant assembly;

wherein said bail allows said prayer bead assembly to pass therethrough said aperture and enable said prayer bead assembly to be movably connected to said pendant assembly.

2. The prayer bead lariat of claim 1, wherein said bail allows said prayer bead assembly to pass therethrough said aperture in a sideways sliding motion.

3. The prayer bead lariat of claim 1, said prayer bead assembly further comprising:

a plurality of beads; and, a chain connecting said plurality of beads.

4. The prayer bead lariat of claim 1, wherein said bail is connected to said pendant assembly by a pendant connector.

5. The prayer bead lariat of claim 1, wherein said pendant assembly further comprises a first pendant portion.

6. The prayer bead lariat of claim 5, wherein said pendant assembly further comprises a second pendant portion.

7. The prayer bead lariat of claim 5, wherein said first pendant portion comprises a variety of components representing various religious symbols.

8. The prayer bead lariat of claim 6, wherein said first pendant portion is connected to said second pendant portion by a pendant chain.

9. The prayer bead lariat of claim 6, wherein said second pendant portion comprises a variety of components representing various religious symbols.

10. The prayer bead lariat of claim 3, wherein said plurality of beads comprises a variety of different beads associated with different religions.

11. A method for utilizing a prayer bead prayer bead lariat, said method comprising the steps of:

providing said prayer bead lariat, further comprising:

a prayer bead assembly;

a pendant assembly; and, a bail having an aperture, wherein said bail is slidingly connected therearound said prayer bead assembly and said bail is directly connected to said pendant assembly;

wherein said bail allows said prayer bead assembly to pass therethrough said aperture and enable said prayer bead assembly to be movably connected to said pendant assembly;

holding said prayer bead assembly;

grasping an individual bead;

reciting a corresponding prayer or recitation;

sequentially reciting additional prayers, chants, or recitations while grasping subsequent beads, thereby resulting in a sideways sliding motion; and, allowing said prayer bead assembly to incrementally pass therethrough said bail as said pendant assembly remains stationary.

12. The method of claim 11, further comprising the steps of:

placing said prayer bead assembly of said device therearound a neck of a user; and, positioning said pendant assembly thereupon a chest area of said user.

* * * * *